US009499945B2

(12) United States Patent
Vazquez Ruiz Del Arbol

(10) Patent No.: US 9,499,945 B2
(45) Date of Patent: Nov. 22, 2016

(54) METHODS FOR THE CONSTRUCTION AND REPAIR OF CONCRETE PAVEMENTS

(71) Applicant: José Ramón Vazquez Ruiz Del Arbol, Madrid (ES)

(72) Inventor: José Ramón Vazquez Ruiz Del Arbol, Madrid (ES)

( * ) Notice: Subject to any disclaimer, the term of this patent is extended or adjusted under 35 U.S.C. 154(b) by 0 days.

(21) Appl. No.: 14/420,857

(22) PCT Filed: Aug. 14, 2013

(86) PCT No.: PCT/ES2013/000192
§ 371 (c)(1),
(2) Date: Mar. 11, 2015

(87) PCT Pub. No.: WO2014/027124
PCT Pub. Date: Feb. 20, 2014

(65) Prior Publication Data

US 2015/0204025 A1 Jul. 23, 2015

(30) Foreign Application Priority Data

Aug. 17, 2012 (ES) ..... 201200831

(51) Int. Cl.
*E01C 11/06* (2006.01)
*E01C 11/00* (2006.01)
(Continued)

(52) U.S. Cl.
CPC ..... *E01C 11/005* (2013.01); *E01C 7/00* (2013.01); *E01C 11/06* (2013.01); *E01C 11/14* (2013.01); *E01C 23/025* (2013.01)

(58) Field of Classification Search
CPC ..... E01C 11/04; E01C 11/06; E01C 11/10; E01C 11/103; E01C 11/12; E01C 11/123
USPC ..... 404/49, 56, 67, 68
See application file for complete search history.

(56) References Cited

U.S. PATENT DOCUMENTS 1,505,174 A * 8/1924 Triol ..... E01C 11/123 404/50
1,731,335 A * 10/1929 Fischer ..... E01C 11/08 404/74

(Continued)

FOREIGN PATENT DOCUMENTS

| | | | |
|---|---|---|---|
| DE | 3526792 | A1 | 2/1987 |
| FR | 2371549 | A1 | 6/1978 |
| GB | 181930 | A | 6/1922 |

OTHER PUBLICATIONS

International Search Report, Nov. 27, 2013, from International Phase of the instant application.

*Primary Examiner* — Thomas B Will
*Assistant Examiner* — Katherine Chu
(74) *Attorney, Agent, or Firm* — Cahn & Samuels, LLP

(57) ABSTRACT

Methods for the construction and repair of concrete pavements. The methods comprise forming, along each joint between adjacent slabs, parallel to the vertical plane thereof, a plurality of surface recesses (23, 43) in adjacent slabs (41, 21), alternately on either side of the joint (11), the maximum height of the recesses being smaller than the thickness of the pavement, and a plurality of holes (27, 27'; 47, 47') at the edges of adjacent slabs (21, 41) with, at least, one part shared with said surface recesses (23, 43), and filling said plurality of surface recesses (23, 43) and said plurality of holes (27, 27'; 47, 47') with concrete so as to form a plurality of connectors (22, 42) in the form of teeth (25, 45) for transferring loads between adjacent slabs (21, 41) and columns (29, 29'; 49, 49')for supporting said teeth (25, 45).

15 Claims, 3 Drawing Sheets

(51) Int. Cl.

| | |
|---|---|
| ***E01C 11/14*** | (2006.01) |
| ***E01C 7/00*** | (2006.01) |
| ***E01C 23/02*** | (2006.01) |

(56) References Cited

U.S. PATENT DOCUMENTS 1,874,591 A * 8/1932 Older ..... E01C 11/123 404/69
2,174,040 A 9/1939 Mutschler
2,431,385 A * 11/1947 Fischer ..... E01C 11/106 404/49
3,595,142 A * 7/1971 Via ..... E01D 19/06 404/49
3,713,368 A * 1/1973 McDowell ..... E01D 19/06 404/32
4,362,429 A * 12/1982 Puccio ..... E01D 19/06 215/320
5,028,168 A * 7/1991 Conversy ..... E01D 19/06 404/47
6,039,503 A * 3/2000 Cathey ..... E01C 11/10 14/73.1
6,183,575 B1 * 2/2001 Embelton ..... E01C 7/147 156/71
8,511,931 B2 * 8/2013 Klotz ..... E01B 25/28 404/40

* cited by examiner

METHODS FOR THE CONSTRUCTION AND REPAIR OF CONCRETE PAVEMENTS

FIELD OF THE INVENTION

The present invention pertains to methods for the construction and repair of concrete pavements, in particular, methods which facilitate the transmission of loads between adjacent slabs making up the pavement.

The invention is applicable to linear and surface works such as roads, highways, concrete concourses, etc.

PRIOR ART

Although at times one opts to demolish and rebuild a pavement or produce another pavement on top of an existing one, the customary technique for repairing pavements of concrete roadways (when the problem is the lack of a good transmission of loads between slabs) consists in removing the pins arranged between the slabs of the pavement and replacing them with others.

It is also usually necessary to inject the cavities present between the pavement and the ground in the zone beneath the joint between slabs and grind or scrape the surface of the pavement to eliminate the difference in height between edges of adjacent slabs.

The technique of building or rebuilding pavements with pins produces high stresses in the concrete around the pin, in the zone closest to the joint, these high stresses causing the concrete to wear down and gaps are formed between the pin and the concrete, decreasing the efficiency of the pin as a load transmission mechanism over time.

One very common fault or problem in the pavement of concrete roadways is the height difference between edges of slabs in the joint transverse to the roadway, which can be permanent or can develop at the moment of passage of a load.

In general, after a time, the system of load transmission between slabs of the concrete pavement no longer works adequately. In the direction of travel, the slabs form a downward stairway, causing an annoying tac-tac sound, especially in the heavy truck lane.

The present invention is aimed at solving those problems both in the construction of new pavements and in the repair of deteriorated pavements.

SUMMARY OF THE INVENTION

An object of the present invention is to provide methods of construction and repair of concrete pavements in which there is an efficient and long-lasting transfer of loads between adjacent slabs.

In both cases, this object is achieved by making joints between adjacent slabs in the pavement being repaired or the pavement of new construction, these joints comprising connectors that allow for a transfer of loads between them to ensure the stability of the pavement, preventing misalignment of adjacent slabs.

For this, first a plurality of surface recesses are made in adjacent slabs, these recesses alternating on either side of the joint with a maximum height of less than the thickness of the pavement, and a plurality of holes in the edges of adjacent slabs, these holes having at least one part in common with said surface recesses, and then said plurality of surface recesses and said plurality of holes are filled with concrete to form said connectors in the form of teeth for transferring loads between adjacent slabs and straight or curved columns for securing said teeth.

In the case of a pavement of new construction, the aforementioned joints are made after having laid the concrete and having made cuts in it for the formation of slabs once a certain level of setting has been achieved.

In the case of a pavement under repair, said joints are formed directly so as not to interfere with any existing pins between adjacent slabs.

In one embodiment of the invention, said teeth have the shape of a circular cylindrical sector and said securing columns have a cylindrical shape, each pair being configured as a V shape.

Other desirable characteristics and advantages of the present invention will be made clear from the following detailed description of the invention and the appended claims, in relation to the accompanying drawings.

DETAILED DESCRIPTION OF THE INVENTION

The methods of construction and repair of concrete pavements according to the invention share the steps needed to make joints between adjacent slabs so as to facilitate a transmission of loads between them; therefore, we shall focus on them in this description.

In the case of construction of a new pavement, the steps mentioned are carried out once a certain level of setting has been achieved for the concrete laid continuously and after making cuts in the pavement in predetermined locations to divide it into slabs.

In the case of repair of a deteriorated pavement, the steps mentioned are carried out directly or after a previous step of making additional cuts in particular locations in the pavement to decrease the size of the slabs of which it is composed.

Figure 1:
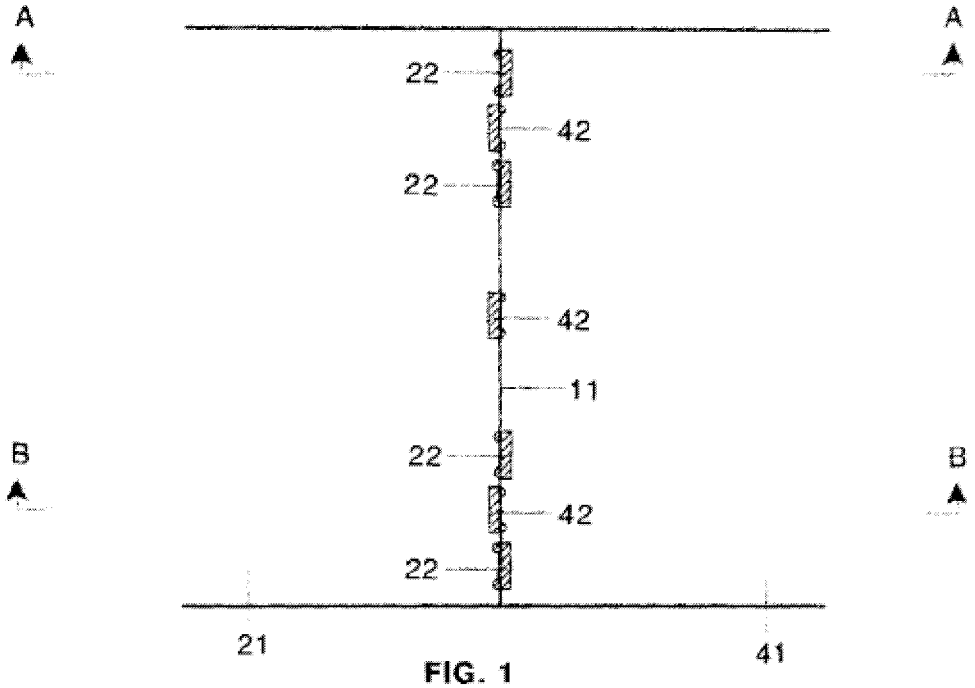
FIG. 1 is a plan view of a transverse joint of a roadway lane with a set of connectors according to the present invention.

The joints between slabs made in the methods of construction and repair of pavements according to one embodiment of the invention comprise (see FIG. 1) a plurality of connectors 22, 42 arranged alternately between the adjacent slabs 21, 41 along the joint 11 in order to transmit the loads between them.

In the case of a method for repair of a pavement with pins between adjacent slabs, the connectors 22, 42 are arranged so as not to interfere with the latter.

The connectors 22, 42 are made by filling certain recesses and holes made in the adjacent slabs 21, 41 with concrete.

Figure 2A:
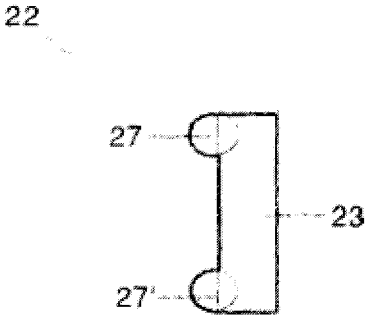
FIGS. 2*a* and 2*b* are enlarged plan views of the two types of connectors used in the present invention.
Figure 3A:
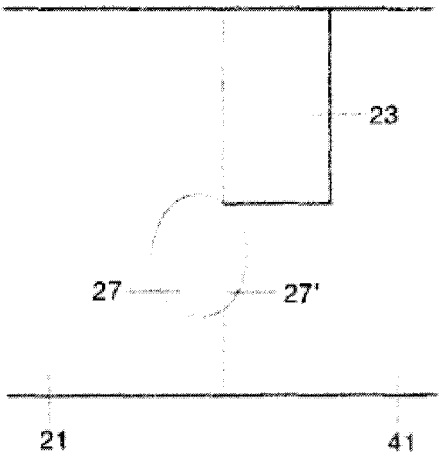
FIGS. 3*a* and 3*b* are cross-sectional views of the joint along plane A-A of FIG. 1, showing the surface recess and the hole which are filled with concrete to form, respectively, the tooth and the securing column which form one of the types of connector used in the present invention.

In order to make the connectors 22 (see FIGS. 2*a* and 3*a*), surface recesses 23 of a rectangular surface in plan view are made in the slab 41 and a pair of holes 27, 27' are made in both adjacent slabs 21, 41, although with a greater portion in the slab 21 in a direction parallel to the vertical plane of the joint 11. The pair of holes 27, 27' are configured in V shape so that the two are joined in their end part, corresponding to the situation shown in FIG. 3*a*. The holes 27, 27' preferably have a circular cross section.

Figure 2B:
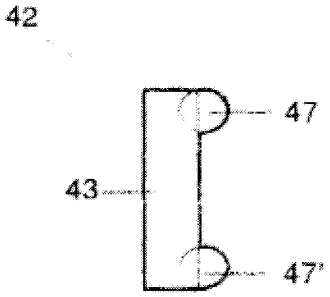
Figure 4A:
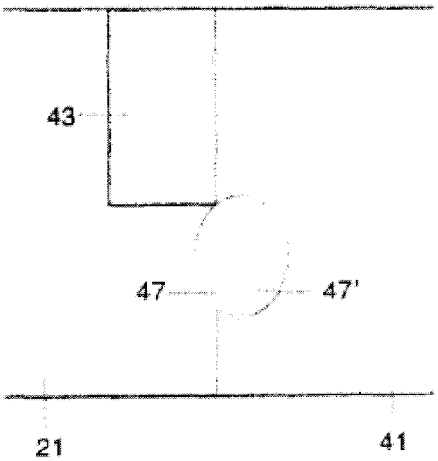
FIGS. 4*a* and b are cross-sectional views of the joint along plane B-B of FIG. 1, showing the surface recess and the hole which are filled with concrete to form, respectively, the tooth and the securing column which form the other type of connector used in the present invention.

Similarly, in order to make the connectors 42 (see FIGS. 2*b* and 4*a*) surface recesses 43 of a rectangular surface in plan view are made in the slab 21 and a pair of holes 47, 47' are made in both adjacent slabs 21, 41, although with a greater portion in the slab 41 in a direction parallel to the vertical plane of the joint 11 and configured in V shape.

Figure 3B:
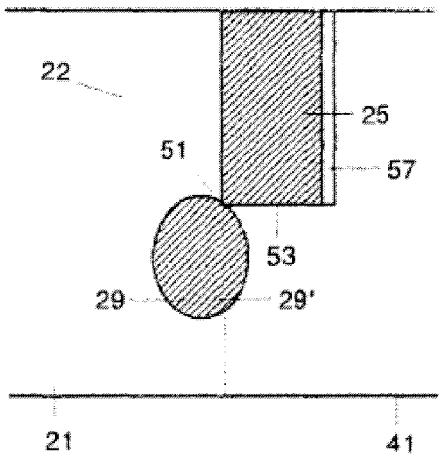
Figure 4B:
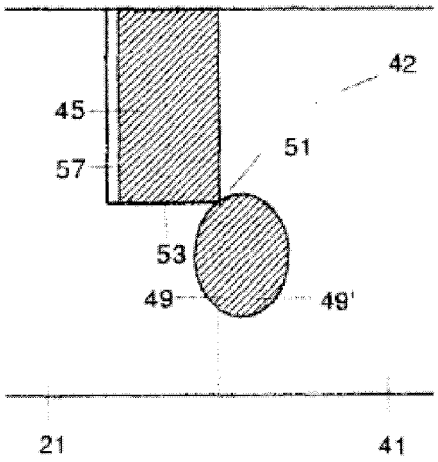

These recesses and holes are filled with concrete so that teeth 25, 45 are formed in the surface recesses 23, 43 and columns 29, 29'; 49, 49' of cylindrical shape securing said teeth 25, 45 are formed in the pairs of holes 27, 27'; 47, 47' (see FIGS. 3*b* and 4*b*).

Figure 5:
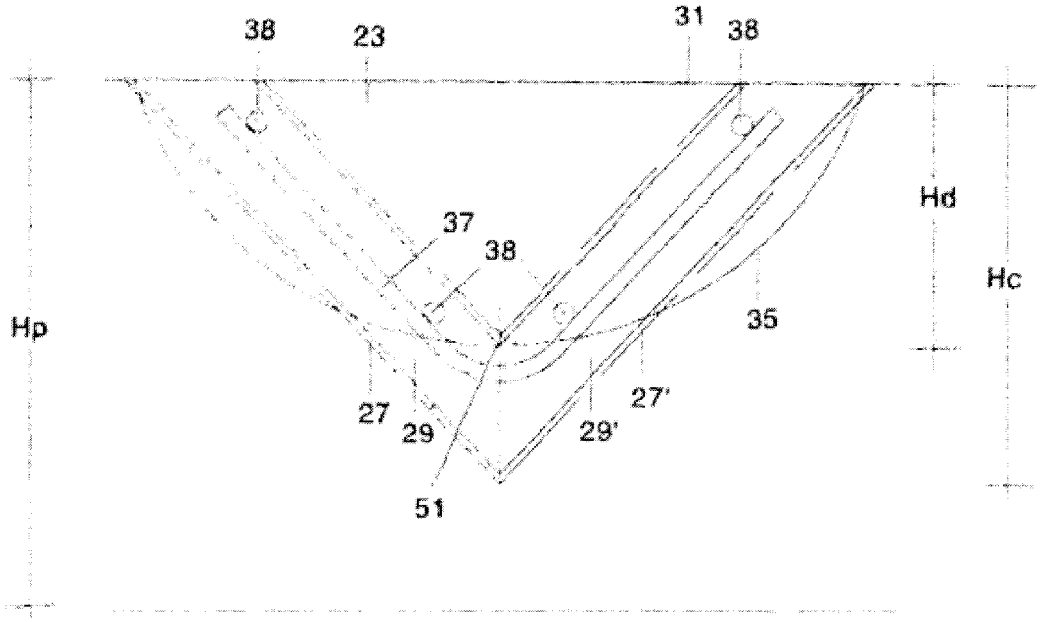
FIG. 5 is a view in elevation of a joint according to the invention in the zone of a surface recess, illustrating its curved configuration and the arrangement of the inclined holes and the securing columns formed in them.

As can be seen in FIG. 5, the surface recess 23 preferably has the shape of a circular cylindrical segment with its plane surface 31 aligned with the surface of the adjacent slabs and its curved surface 35 configured such that its maximum height Hd is preferably comprised between ⅕ and ⅔ of the thickness Hp of the pavement. This configuration is appropriate both for the tooth 25 that is formed in the recess 23 to perform its function of transmitting loads and for it to be made with a single or double disk saw, depending on the dimension of the surface recess 23 perpendicular to the joint 11.

In a preferred embodiment for pavements subjected to large loads, as in the case of harbor and airport concourses, the surface recesses 23 have the shape of an elongated cylindrical circular segment, that is, with a plane and horizontal lower part.

This same FIG. 5 shows the inclined holes 27, 27' (by broken line) and the securing columns 29, 29' formed in them. The intersection of the holes 27, 27' and the recess 23 is the point of zero shrinkage (see FIGS. 3*b* and 5).

Both the teeth 25 formed in the recesses 23 and the securing columns 29, 29' can be made of reinforced concrete. In this regard, FIG. 5 shows a reinforcement of the securing columns 29, 29' formed by a curved bar 37 and bars 38 perpendicular to the vertical plane of the joint 11. The reinforcement of the teeth 25 is not shown, being similar to the above, and which can be arranged inclined relative to the vertical plane of the joint 11.

In addition, the concrete filling of the surface recess 23 and the inclined holes 27, 27' of the connector 22 can be a concrete incorporating galvanized or stainless metallic fibers. One can also use low-shrinkage concretes.

Figure 6:
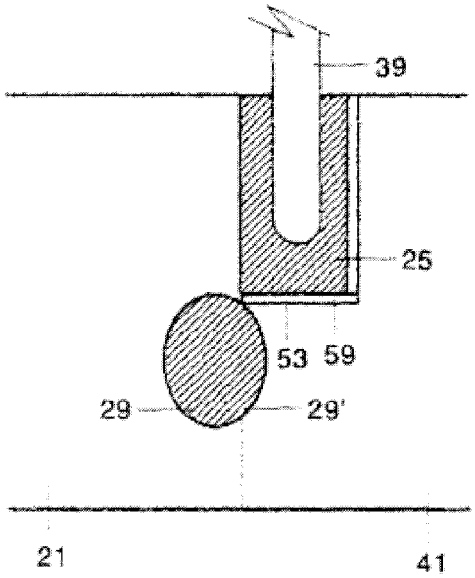
FIG. 6 is similar to FIG. 3*b*, adding certain structural details.

In any case, the concrete filling the surface recess 23 and the holes 27, 27' should be vibrated with vertical needles 39 of small diameter, situated in the axis of the groove (see FIG. 6).

As is shown in FIG. 3*b*, the tooth 25 and the securing columns 29, 29' are arranged in the connector 22 so that there is a point of contact 51 between them in the vertical plane of the joint that does not move with the shrinkage of the concrete fill. All the points of the concrete fill will tend toward the point 51, owing to the shrinkage thereof For this, by moving the disk saw horizontally, it is possible to increase the points with zero separation between the concrete fill and the horizontal surface 53 of the slab 41, increasing the surface and the uniformity of the support 53 forming an elongated cylindrical circular segment.

Thus, the connector 22 transmits the load of the slab 21 to the slab 41 across the support surface 53 of the tooth 25 in the slab 41, so that any horizontal movements of the slabs 21, 41 will not affect the support level between them. Therefore, even though the width of the fissure of the joint 11 varies over the course of the year due to temperature variations, the transmission of loads will not be affected. For its part, the arrangement of the connector 22 means that downward vertical movements of the slab 21 are transmitted to the slab 41.

In the manner as described, one achieves a transfer with initial efficiency of 100%. Thanks to the fact that the load is vertical and the relieving surface is horizontal, there is only compression in the support surface 53 between the slabs 21 and 41. There is no rubbing in the transmission of loads to cause wear on the contact zone. Moreover, since the pressures are distributed over much of the surface, their value is low and therefore enables a long lifetime of the connector 22 and the support 53 of the slab 41.

For its part, the effect of rubbing due to changes in the length of the adjacent slabs due to temperature is considered to be slight, so that the efficiency of the load transmission is considered to be permanent or practically permanent.

In order to enable horizontal movement between slabs, contact between the vertical wall of the tooth 25 of the slab 21 and the slab 41 is avoided by arranging a separating plate 57 which is removed after the concreting in situ (see FIGS. 3*b* and 4*b*). The separating plate 57 can be placed in an inclined position, shoving it into the fresh concrete from the surface line of the joint 11 up to the support surface 53. This enables a more convenient sealing afterwards along the line of the joint 11 and makes the surface level of the tooth 25 independent of possible twisting of the slab 21. The separating plate 57 can be replaced by a cut.

In turn, in order to enable twisting movements between adjacent slabs, a band 59 of material more compressible than concrete, such as polypropylene is disposed on the support surface 53 of the tooth 25 in the slab 41 (see FIG. 6). Without the band 59, the support between the slab 21 and the slab 41 is direct, achieving a transmission of 100%, but then it is necessary to arrange the band 59 on top of the support surface 53 of the tooth 45 in the slab 21. This band 59 can have a rectangular, triangular, trapezoidal section or one with curvature at the edges to facilitate a small angle enabling twisting between the slabs. It is considered that the band 59 can have a long lifetime, being subjected only to compression loads and rubbing due to movements caused by temperature change.

Everything stated above about the connectors 22 is applicable, *mutatis mutandi*, to the connectors 42.

In pavements of harbor or airport concourses, the connectors 22 and 42 need to be equal, because the loads travel in both directions.

In pavements of roadways, the connectors 22 and 42 can be situated in different form in the various lanes of the roadway depending on the type of traffic, the load situation, or the possible use of other layers.

Even though the present invention has been described in connection with one embodiment, one will realize from the description that there can be various combinations of elements, variations or improvements that are within the scope of the invention.

The invention claimed is:

1. A method for construction of a concrete pavement, said method comprising:

a) laying the concrete on the surface being paved in continuous manner;

b) making a plurality of cuts in predetermined locations in the laid concrete once a predetermined degree of setting is achieved to lay out the pavement with a group of adjacent slabs separated by joints;

c) making along each joint and parallel with a vertical plane of each said joint:

a plurality of surface recesses in adjacent slabs alternately on either side of the joint with a maximum height of less than the thickness of the pavement;

a plurality of holes in the edges of adjacent slabs with a part common to said surface recesses;

d) filling with concrete said plurality of surface recesses and said plurality of holes to form a plurality of load transfer teeth between adjacent slabs, the load transfer teeth enable transfer of loads to columns securing the load transfer teeth.

2. The method for construction according to claim 1, in which said plurality of surface recesses have the shape of a cylindrical body with a base in the shape of a circular segment or an elongated circular segment.

3. The method for construction according to claim 2, in which the maximum height of the base of said cylindrical body is comprised between ⅕ and ⅔ of the thickness of said adjacent slabs.

4. The method for construction according to claim 1, in which step d) is carried out by placing a separating plate between the vertical walls of said surface recesses and the slabs and a band of material with an elastic modulus of compression less than that of the concrete on one of the support surfaces of said teeth.

5. The method for construction according to claim 1, in which said plurality of holes is formed by a plurality of pairs of holes parallel to the vertical plane of the joint and arranged in a V configuration so that the columns are joined at their lower part.

6. The method for construction according to claim 1, in which step d) is carried out after arranging metal reinforcements in the securing columns and at a metal bar in said surface recesses.

7. The method for construction according to claim 6, in which a concrete with metal fibers of stainless or galvanized steel is used in said step d).

8. A method for repair of a concrete pavement formed by a set of adjacent slabs separated by joints, said method comprising:

a) making along each joint and parallel with a vertical plane of each said joint:

a plurality of surface recesses in adjacent slabs alternately on either side of the joint with a maximum height of less than the thickness of the pavement;

a plurality of holes in the edges of adjacent slabs with a part common to said surface recesses;

b) filling with concrete said plurality of surface recesses and said plurality of holes to form a plurality of load transfer teeth between adjacent slabs, the load transfer teeth enable transfer of loads to columns securing the load transfer teeth.

9. The method for repair according to claim 8, in which said plurality of surface recesses have the shape of a cylindrical body with a base in the shape of a circular segment or an elongated circular segment.

10. The method for repair according to claim 9, in which the maximum height of the base of said cylindrical body is comprised between ⅕ and ⅔ of the thickness of said adjacent slabs.

11. The method for repair according to claim 8, in which step b) is carried out by placing a separating plate between the vertical walls of said surface recesses and the slabs and a band of material with an elastic modulus of compression less than that of the concrete on one of the support surfaces of said teeth.

12. The method for repair according to claim 8, in which said plurality of holes is formed by a plurality of pairs of holes parallel to the vertical plane of the joint and arranged in a V configuration so that the columns are joined at their lower part.

13. The method for repair according to claim 8, in which step b) is carried out after arranging metal reinforcements in the securing columns and at a metal bar in said surface recesses.

14. The method for repair according to claim 13, in which a concrete with metal fibers of stainless or galvanized steel is used in said step b).

15. The method for repair according to claim 8, which likewise comprises a prior step of making cuts in the pavement arranged so as to reduce the size in plan view of the slabs making up the pavement.

* * * * *